US006530296B1

(12) United States Patent
Liao

(10) Patent No.: US 6,530,296 B1
(45) Date of Patent: Mar. 11, 2003

(54) UNIDIRECTIONAL RATCHET WRENCH

(76) Inventor: Hui-Chen Liao, No. 14, Lane 155, Sec. 3, Hsi-Tun Rd., Taichung (TW)

( * ) Notice: Subject to any disclaimer, the term of this patent is extended or adjusted under 35 U.S.C. 154(b) by 0 days.

(21) Appl. No.: 10/041,518

(22) Filed: Jan. 7, 2002

(51) Int. Cl.[7] ..... B25B 13/46

(52) U.S. Cl. ..... 81/60; 81/58; 81/58.4; 192/43.2

(58) Field of Search ..... 81/60, 58, 58.2, 81/58.4; 192/43.2, 45.1, 46, 44, 54.2

(56) References Cited

U.S. PATENT DOCUMENTS 1,271,671 A * 7/1918 Cooper ..... 81/60
4,796,492 A * 1/1989 Liou ..... 81/58
5,878,635 A * 3/1999 Hsieh ..... 81/61
6,357,323 B2 * 3/2002 Chi et al. ..... 81/60

FOREIGN PATENT DOCUMENTS

DE 3319-818 A * 12/1984 ..... 81/60

* cited by examiner

*Primary Examiner*—James G. Smith
*Assistant Examiner*—Hadi Shakeri
(74) *Attorney, Agent, or Firm*—Schwegman, Lundberg, Woessner & Kluth, P.A.

(57) ABSTRACT

A unidirectional ratchet wrench essentially comprises a wrench body (10), a ratchet (20), an expending ring (30) and a plurality of clamping blocks (40). The ratchet (20) is rotatably mounted inside the wrench body and has the clamping blocks (40) evenly spaced around the ratchet (20) to engage the wrench body (10), whereby the unidirectional wrench has excellent torsion-resisting efficiency and an endurable extension life.

5 Claims, 6 Drawing Sheets

UNIDIRECTIONAL RATCHET WRENCH

BACKGROUND OF THE INVENTION

1. Field of the Invention

The present invention relates to a unidirectional ratchet wrench, and more particularly to a unidirectional ratchet wrench that has excellent torsion-resisting force.

2. Description of Related Art

With reference to FIGS. 6 and 7, a conventional unidirectional ratchet wrench, invented by the applicant of this invention, is essentially composed of a wrench body (60) and a socket assembly.

The wrench body (60) has a toothed cavity (61) defined in one end of the wrench body (60) to receive the socket assembly in the toothed cavity (61). Multiple teeth (62) are formed longitudinally on an inner periphery of the toothed cavity (61). Each tooth (62) has an inclined face (621) and an upright face (623), and the inclined faces (621) of the teeth (62) are all arranged in the same direction.

The socket assembly is composed of a socket wheel (70), two pawls (74) and a split ring (76). A socket (71) is defined in the socket wheel (70) and is adapted to engage a nut or the similar fitting. Two pawl recesses (72) are defined longitudinally in an outer periphery of the socket wheel (70) to hold the two pawls (74) inside, and a groove (73) is defined around in the outer periphery of the socket wheel (70) to receive the split ring (76). Each pawl (74) is a curved sheet with a tapered thickness and a slot (741) transversally defined in the central part of an outer periphery of the pawl (74). A locking end (75) is formed on a thin edge of each pawl (74), and a lever end (751) formed on a thick edge opposite to the thin edge of each pawl (74). When the two pawls (74) are inside the pawl recesses (74) of the socket wheel (70), the slots (741) of the pawls align with the groove (73) in the socket wheel (70) and have a special cut or orientation to allow the pawls (74) to rock inside. The split ring (76) resiliently holds the pawls inside the pawl recesses (74) and compresses the lever end (53) of the pawls (74) to make the locking end (75) of the pawls lever outwardly. Whereby, the split ring (76) provides a restitution force on the pawls (74) to make the pawls (74) mate with the teeth (62) and then to lock the socket wheel (70) with the wrench body (60). Additionally, two locking rings (77) are mounted on opposite openings of the toothed cavity (61) to hold the socket assembly inside the wrench body (60).

When the conventional unidirectional ratchet wrench operates, the wrench body (60) is rotated to make the locking ends (751) of the pawls (74) engage the straight faces (623) of the teeth (62). Then, the socket wheel (70) is twisted by the wrench body (60) and rotates with the wrench body (60) so that a nut inside the socket (71) is also rotated. When the wrench body (60) is rotated in the opposite direction, the locking ends (751) of the pawls (74) move along the inclined faces (621) of the teeth (62). Then, the socket wheel (70) does not rotate with the wrench body, and the wrench is in an idle running state.

However, the conventional unidirectional ratchet wrench has the following drawbacks:

1. The slot (741) in each pawl (74) has to be defined precisely in a special cut and orientation. Otherwise, the pawl (74) cannot be levered to engage the locking end (75) with the teeth (61) perfectly, and then the torsion-resisting force of the conventional unidirectional ratchet wrench is weak.

2. The torsion-resisting efficiency of the wrench is provided by the locking ends (751) of the pawls (74) and is uneven and insufficient. Therefore, the split ring (74) easily deforms when the torsional force is slightly exceeded.

To make the unidirectional ratchet wrench endurable, the present invention has arisen to mitigate and/or obviate the disadvantage of the conventional unidirectional ratchet wrench.

SUMMARY OF THE INVENTION

The main objective of the present invention is to provide a unidirectional ratchet wrench that has excellent torsion-resisting efficiency.

Further benefits and advantages of the present invention will become apparent after a careful reading of the detailed description with appropriate reference to the accompanying drawings.

DETAILED DESCRIPTION OF THE INVENTION

Figure 1:
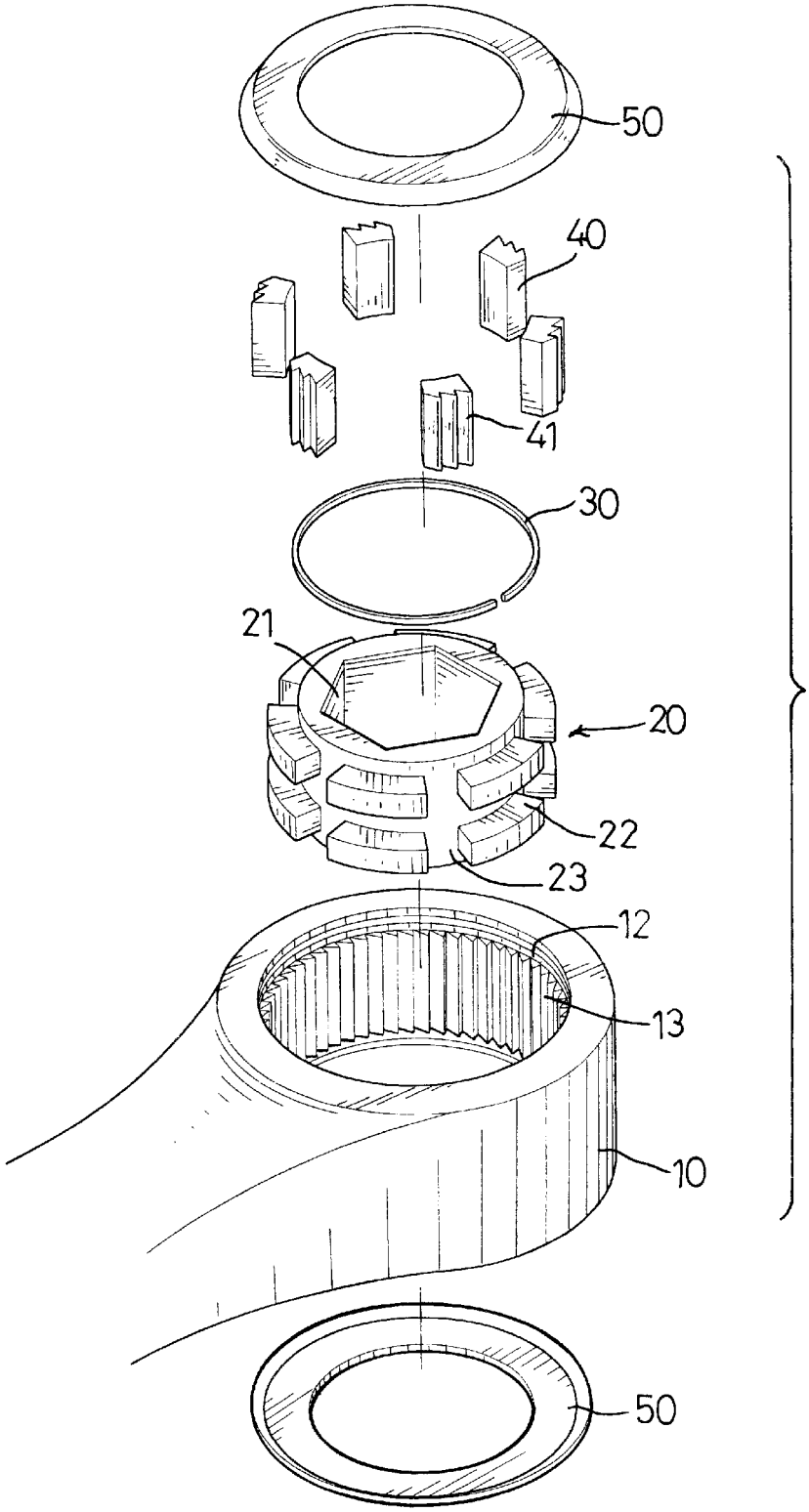
FIG. 1 is an exploded perspective view of a unidirectional ratchet wrench in accordance with the present invention.
Figure 2:
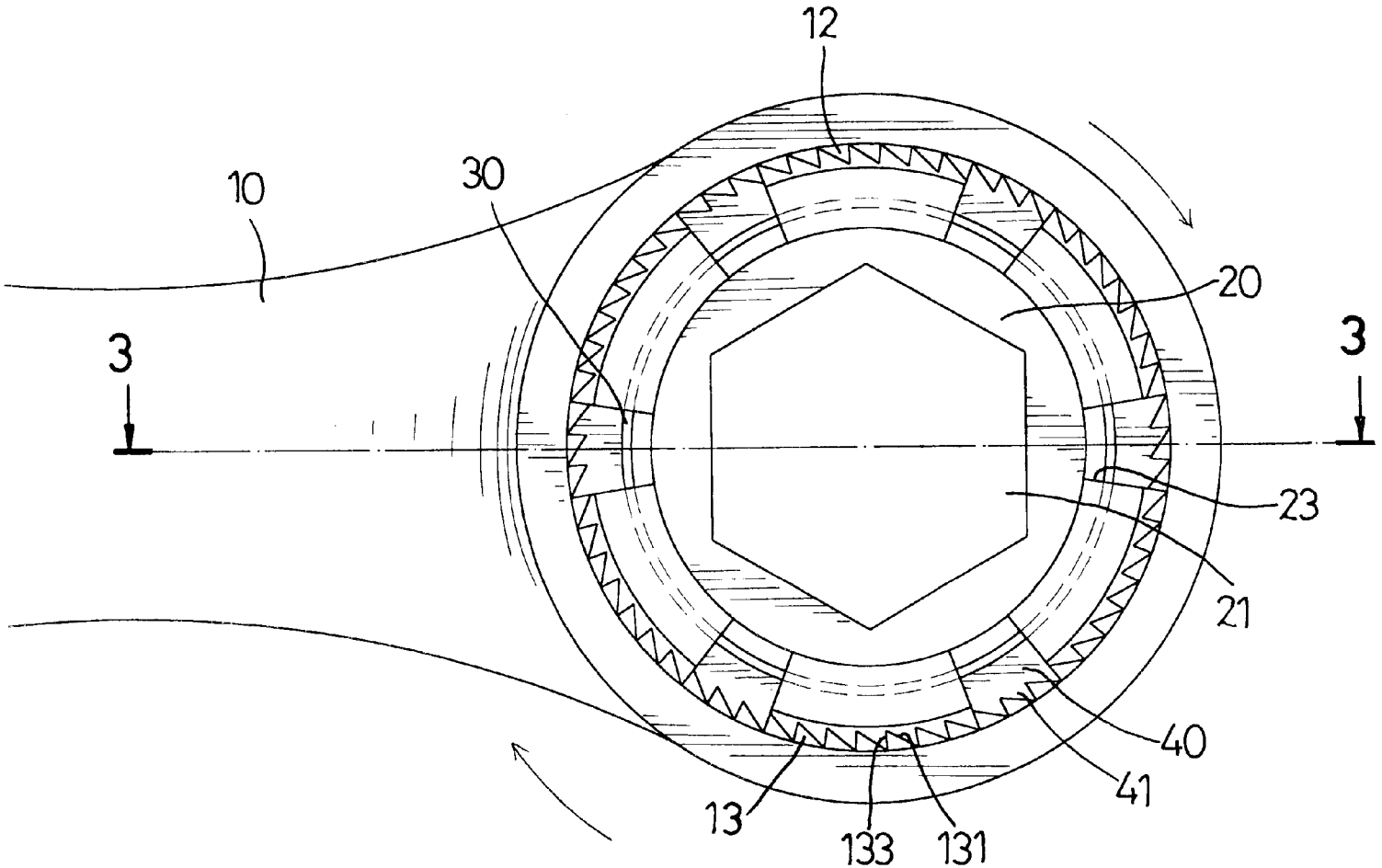
FIG. 2 is an operational cross-sectional top plan view of the unidirectional ratchet wrench in FIG. 1.

With reference to FIGS. 1 and 2, a unidirectional ratchet wrench in accordance with the present invention comprises a wrench body (10), a ratchet (20), an expanding ring (30) and multiple clamping blocks (40).

A toothed cavity (12) is defined in one end of the wrench body (10) to hold the ratchet (20) and other elements. Multiple teeth (13) are formed longitudinally on an inner periphery of the toothed cavity (12). Each tooth (13) has an inclined face (131) and an upright face (133), and all inclined faces (131) of the teeth (13) are arranged in the same direction.

The ratchet (20) has a socket (21) defined in the center and adapted to engage a nut or similar fitting, wherein the socket (21) is defined in polygon. A ring recess (22) is transversally defined around an outer periphery of the ratchet (20) and at least two block recesses (23) are evenly and longitudinally defined in the outer periphery of the ratchet (20). In this preferred embodiment, five block recesses (23) are spaced evenly around the ratchet (20).

The expanding ring (30) is mounted in the ring recess (22) and has its inner diameter slightly larger than an outer diameter of a portion within the ring recess (22) of the ratchet (20), wherein the expanding ring (30) is made of a resilient circular strip.

At least two clamping blocks (40) mount on the expanding ring (30), correspond to the block recess (23) in the ratchet (20) and have one toothed face facing outward. Each toothed face has multiple teeth (41) to engage the toothed cavity (12) in the wrench body (10). In this preferred embodiment, three teeth (41) are formed on each toothed face of each clamping block (40). Because the expanding ring (30) has a larger diameter than the outer diameter of the ratchet (20), the expanding ring (30) provides a restitution force to push the clamping blocks (40) to engage the teeth (13) in the toothed cavity (12) of the wrench body (10).

Additionally, two covers (50) are mounted on the opposite openings of the toothed cavity (12) of the wrench body (10) to enclosed the ratchet (20) and other elements inside the toothed cavity (12).

Figure 3:
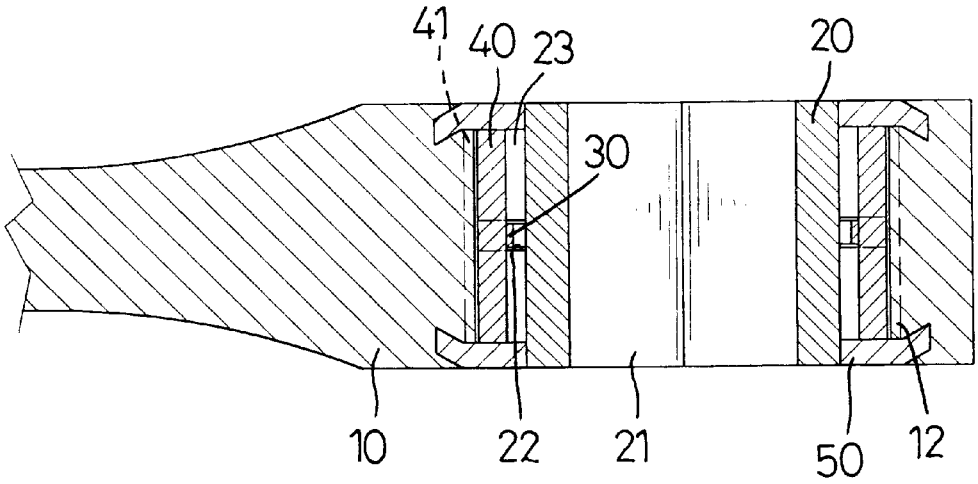
FIG. 3 is a cross-sectional side plan view of the unidirectional ratchet wrench along line 3—3 in FIG. 2, wherein clamping blocks engage with the toothed cavity.

With reference to FIGS. 2 and 3, when the unidirectional ratchet wrench operates, the wrench body (10) is rotated to make the teeth (41) of the clamping blocks (40) engage the straight faces (133) of the toothed cavity (12). Then, the ratchet (20) is pushed by the wrench body (10) and rotates with the wrench body (10) thereby rotating the nut engaged inside the socket (21).

Figure 5:
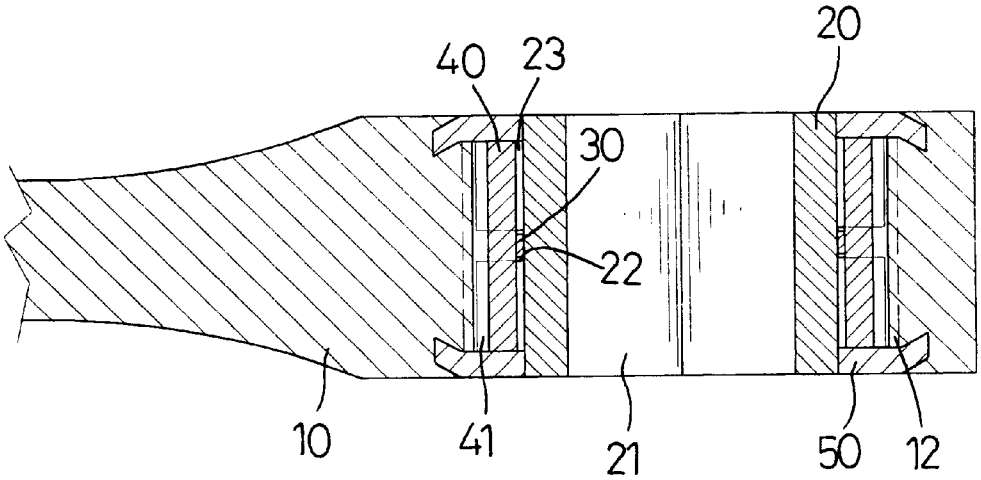
FIG. 5 is a cross-sectional side plan view of the unidirectional ratchet wrench along line 5—5 in FIG. 4, wherein clamping blocks disengage with the toothed cavity.
Figure 4:
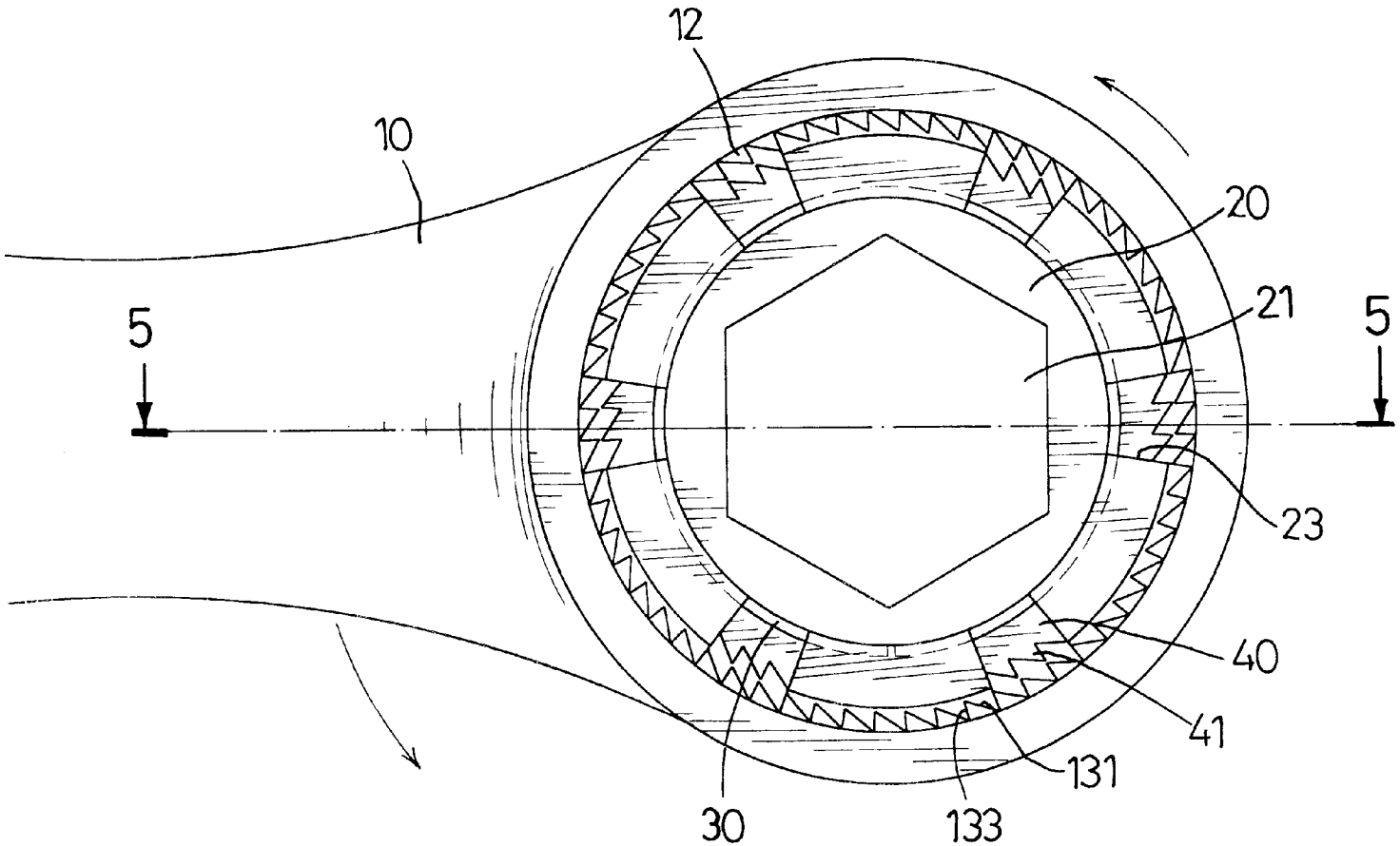
FIG. 4 is a cross-sectional top plan view of the unidirectional ratchet wrench in an idle running.
Figure 6:
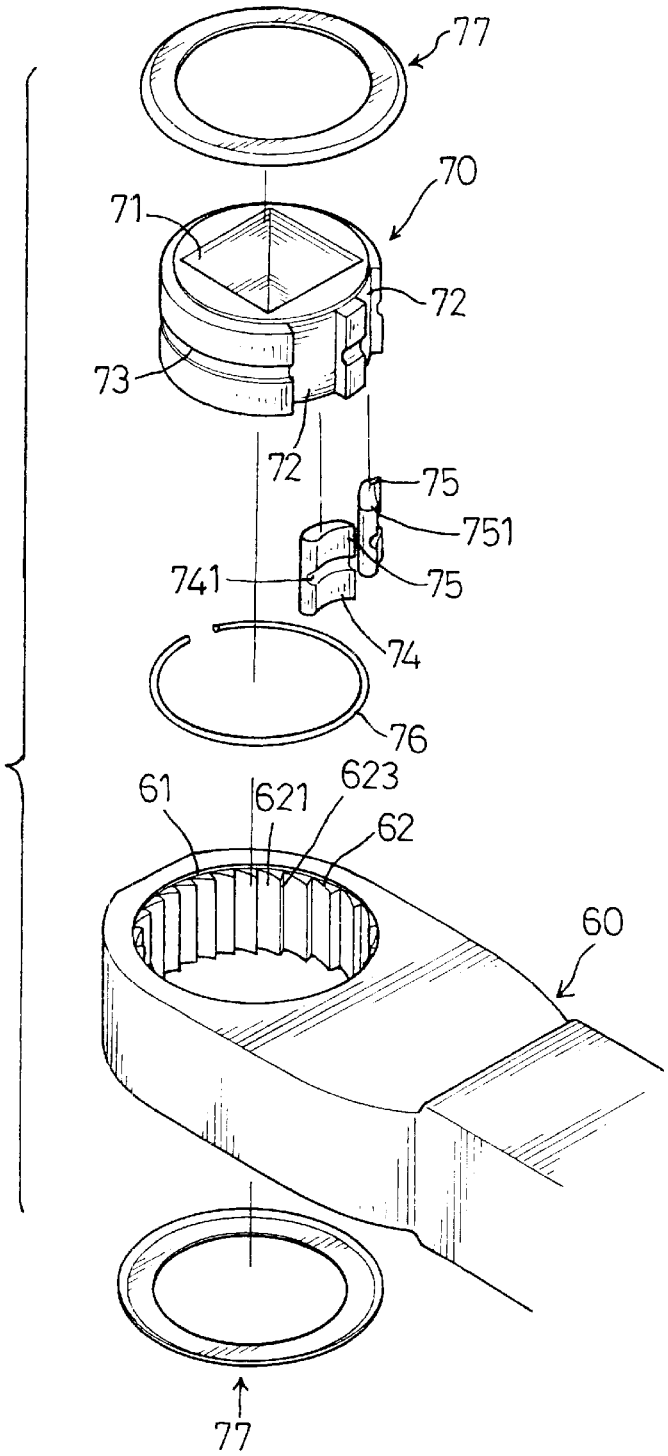
FIG. 6 PRIOR ART
FIG. 6 is an exploded perspective view of a conventional unidirectional ratchet wrench.
Figure 7:
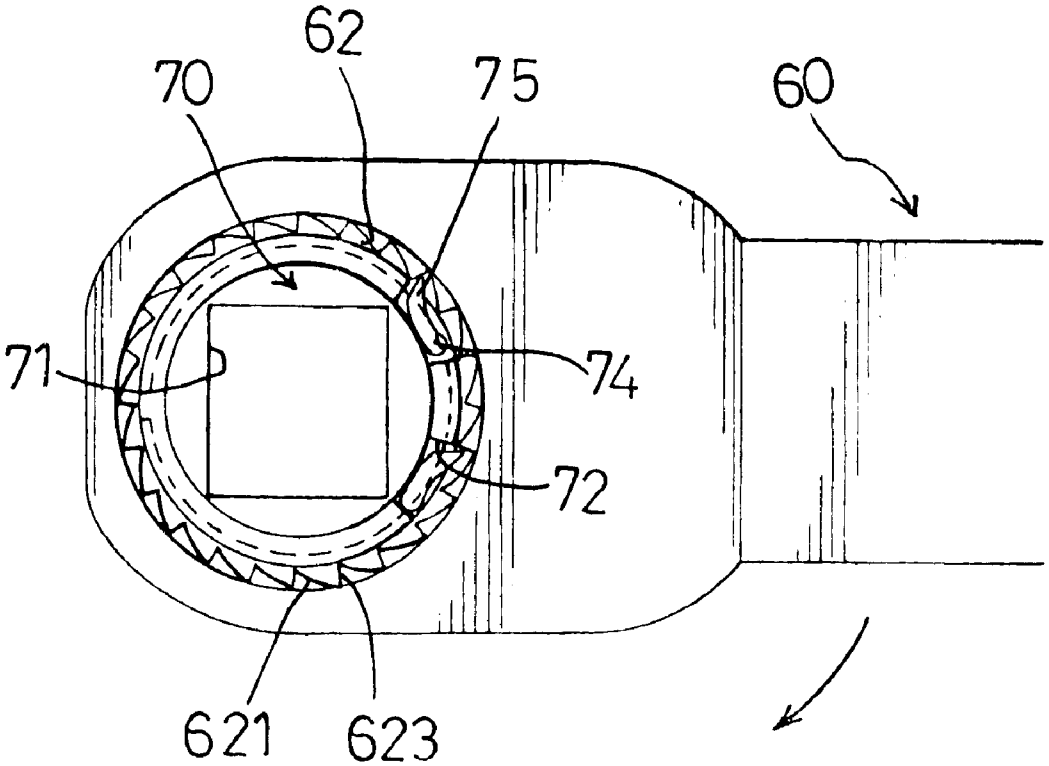
FIG. 7 PRIOR ART
FIG. 7 is a cross-sectional top plan view of the conventional unidirectional ratchet wrench.

With reference to FIG. 4 and 5, when the wrench body (10) is rotated in the opposite direction, the teeth (41) of the clamping blocks (40) move along the inclined faces (131) of the toothed cavity (12) and disengage from the teethed cavity (12). Then, the ratchet (20) does not rotate with the wrench body (10), and the unidirectional ratchet wrench is in an idle running state.

According to foregoing description, the unidirectional ratchet wrench has excellent torsion-resisting efficiency because the clamping blocks (40) are evenly spaced around the ratchet (20) to engage the toothed cavity. Moreover, each clamping block (40) has multiple teeth (41) to engage the wrench body (10), which also enhances the torsion-resisting efficiency of the wrench. Additionally, evenly spacing the clamping blocks (40) also keeps the expanding ring (30) from easily being deformed so that the unidirectional ratchet wrench is endurable in use.

Although the invention has been explained in relation to its preferred embodiment, it is to be understood that many other possible modifications and variations can be made without departing from the spirit and scope of the invention as hereinafter claimed.

What is claimed is:

1. A unidirectional ratchet wrench comprising:

a wrench body (10) having a toothed cavity (12) defined in one end, wherein multiple teeth (13) are formed on an inner periphery of the toothed cavity (12) and each tooth (13) has an inclined face (131) and an upright face (133) where the inclined faces (131) are all arranged in the same direction;

a ratchet (20) unidirectionally and rotatably secured in the toothed cavity (12) of the wrench body (10) and having a socket (21) defined in the ratchet (20) and adapted to engage with a nut or similar fitting;

a ring recess (22) transversally defined around an outer periphery of the ratchet (20); and at least two block recesses (23) defined at even intervals in the outer periphery of the ratchet (20);

an expanding ring (30) mounted in the ring recess (22) and having its inner diameter slightly larger than an outer diameter of a portion within the ring recess (22) of the ratchet (20); and at least two clamping blocks (40) received respectively in the at least two block recesses (23) and mounted on the expanding ring (30), wherein each clamping block (40) has one toothed facing outwardly to mate with the toothed cavity (12) of the wrench (20);

wherein the expanding ring (30) provides a resilient restitution force on the at least two clamping blocks (40) to make the clamping blocks (40) maintain contact with the toothed cavity (12).

2. The unidirectional ratchet wrench as claimed in claim 1, wherein the socket (21) is defined as a regular polygon.

3. The unidirectional ratchet wrench as claimed in claim 1, wherein the expanding ring (30) is a circular strip.

4. The unidirectional ratchet wrench as claimed in claim 1, wherein the wrench body further has two covers (50) respectively mounted on opposite openings in the toothed cavity (12) of the wrench body (10) to enclose the ratchet (20) inside the toothed cavity (12).

5. The unidirectional ratchet wrench as claimed in claim 3, wherein the wrench body further has two covers (50) respectively mounted on opposite openings in the toothed cavity (12) of the wrench body (10) to enclose the ratchet (20) inside the toothed cavity (12).

* * * * *